US005803605A

United States Patent [19]

Masi

[11] Patent Number: 5,803,605

[45] Date of Patent: Sep. 8, 1998

[54] COMPARTMENTAL LAUNDRY BAG

[76] Inventor: Sherrill A. Masi, 441 George St., Ridgewood, N.J. 07450

[21] Appl. No.: 744,465

[22] Filed: Nov. 7, 1996

Related U.S. Application Data

[60] Provisional application No. 60/006,494 Nov. 9, 1995.

[51] Int. Cl. [6] ..... B65D 30/22

[52] U.S. Cl. ..... 383/38; 383/39; 383/41; 383/117; 383/22

[58] Field of Search ..... 383/38, 39, 41, 383/67, 117, 22, 24

[56] References Cited

U.S. PATENT DOCUMENTS

| | | | |
|---|---|---|---|
| 294,757 | 3/1884 | Kohana et al. . | |
| 2,015,119 | 9/1935 | McEwen | 383/117 X |
| 2,899,997 | 8/1959 | Rauen | 383/39 |
| 3,036,616 | 5/1962 | Allen | 383/39 |
| 5,238,305 | 8/1993 | Feller | 383/39 X |
| 5,456,062 | 10/1995 | Wechsler | 383/41 X |

*Primary Examiner*—Jes F. Pascua
*Attorney, Agent, or Firm*—Sheldon H. Parker

[57] ABSTRACT

A bag for rapid washing and drying of small articles consisting of a main pocket and multiple small, individual pockets. Approximately one half of the individual pockets are located on one side of the main pocket with the other pockets located on the opposite side. The individual pockets are off-set and non-overlapping from their counterpart on the opposite side, thereby preventing more than two thicknesses of articles being in the bag. The off-set placement of the pockets provides "open" areas on each side of the main pocket. The bag can also be provided with a hanging loop which allows the bag to be hung for drying or storage reasons.

9 Claims, 7 Drawing Sheets

COMPARTMENTAL LAUNDRY BAG

This is a continuation-in-part of copending application(s) Ser. No. 60,006,494 filed on Nov. 9, 1995.

BACKGROUND OF THE INVENTION

1. Field of the Invention

The invention relates to a laundry bag having multiple compartments which are offset from one another in a manner as to allow for maximum water and air circulation.

2. Brief Description of the Prior Art

Laundry bags have been used for years to contain selected items during washing. Initially, laundry bags were a simple nylon bag with a closure system on the open end. These commonly used bags are useful for confining larger or lightweight items, however heavier items such as socks, tend to cluster together. This clustering prevents even washing and rinsing and slows the drying process. The clustering of articles also increases the time necessary to sort and separate the various articles contained within the bag.

U.S. Design Pat. No. 294,757 was issued to Kahane et al on Mar. 15, 1988 disclosing a main bag with multiple bags affixed to one side. The Kahane et al patent provides the advantage over the single pocket prior art by providing multiple pockets in addition to the single pocket. The Kahane et al design, however, restricts water and air flow. The Kahane et al when filled with clothing, doubles the thickness of the articles, thereby trapping the adjacent articles in the smaller and main bags.

The instant disclosure overcomes the disadvantage of reduced water and air flow while providing the advantage of a main pocket with multiple smaller pockets for segregating and separating articles.

SUMMARY OF THE INVENTION

A laundry bag for rapid washing and drying of small articles consisting of a main pocket and multiple small, individual pockets. Approximately one half of the individual pockets are located on one side of the main pocket with the other pockets located on the opposite side. The individual pockets are off set from their counterpart on the opposite side, thereby preventing more than two thicknesses of articles being in the bag. The off set placement of the pockets provides "open" areas on each side of the main pocket for water and air flow.

By distributing the pockets on either side of the bag, washing and drying time is decreased. The water or air freely enters the main pocket at an open area, filters between the main pocket and the individual pockets, and exits at either a edge or another open area. Prior art bags either place all the articles in one bag or place all the individual pockets on one side, thereby restricting water and air flow and increasing sorting time. The laundry bag can also be provided with a hanging loop which allows the bag to be hung for drying or storage. It is optimal in this embodiment to place the access to the center pocket on the sides to allow for easier placement and removal of items.

In an alternate design, the pockets of the bag can be placed directly across from one another. This design would primarily be used for storage and carrying of items.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
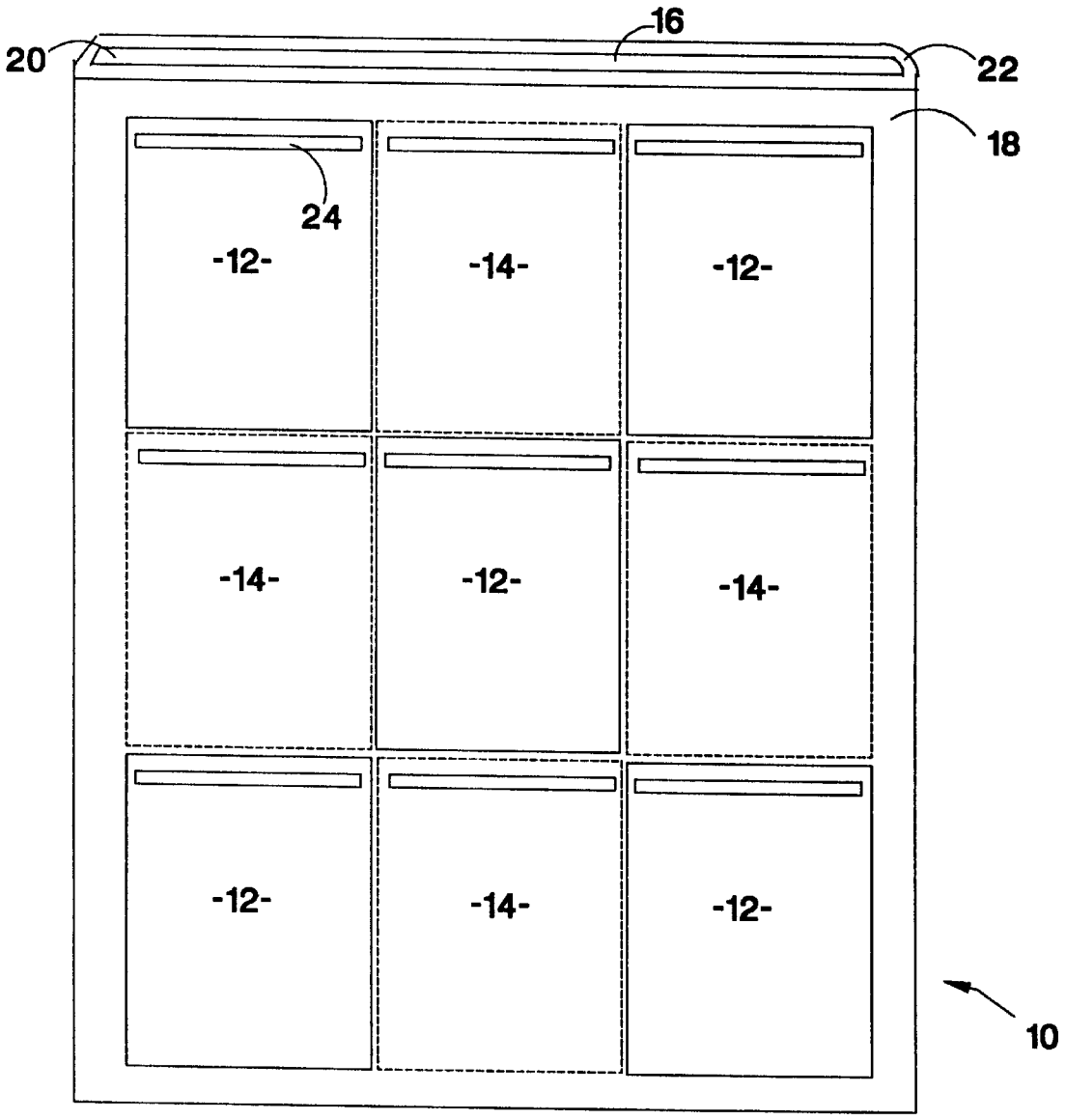
FIG. 1 illustrates a front view of the laundry bag of the instant invention.

The small article laundry bag 10 of the instant invention is illustrated in FIG. 1. The laundry bag 10 allows for the protected and contained washing of multiple small articles, such as socks, lingerie, etc. The preferred material of manufacture is a nylon/polyester mesh, or equivalent thereto, although other materials such as cotton can be used. Nylon/polyester mix mesh provides an advantage in that it does not absorb water and will therefore dry quicker. Although as described herein, the bag is used as a laundry bag, it should be noted that the bag can be used for other uses, such as storage of cosmetics and other small articles. The main benefit of the off-set individual exterior bags is the increased water and air flow, however other benefits in alternate applications will be come apparent to those skilled in the art.

The laundry bag 10 of the instant invention comprises a double layer of mesh, stitched along the edges, to form a large interior pocket 16 with closure means 22 along one edge. This configuration provides the laundry bag 10 with a first side 18 and second side 20. In order to provide thorough washing and rapid drying, the amount of material located in one place within the bag must be minimized. Most of the prior art laundry bags have presented the problem that the contents have a tendency to cluster together. This clustering prevents the articles in the center of the cluster from being washed as thoroughly as the outer articles. Further, the clustering inhibits drying, especially to the center articles. To prevent the natural clustering of articles in an undivided bag, the instant invention provides small, individual pockets in which to wash articles.

In the illustrated example, the first side 18 contains five (5) individual exterior pockets 12 and the second side 20 contains four (4) individual exterior pockets 14. Each of the individual exterior pockets 12 and 14 contain closure means 24 to prevent the contents of the individual pockets 12 and 14 from falling out during laundering. The division of pockets illustrated herein should only be used as a representation and other numbers, sizes and configurations which meet the increased flow-through criteria as set forth herein can be utilized.

The dimensions and placement of the individual exterior pockets 12 and 14 are integral with the thorough washing and rapid drying ability of the bag 10. The individual exterior pockets 12 and 14 must be placed and dimensioned to avoid the alignment and overlapping of the individual pockets 12 on the first side 18 and the individual pockets 14 of the second side 20.

The nonaligned exterior individual pockets 12 and 14 maintain the articles in a predetermined location which prevents clustering. The containment of the articles provides the additional advantage of evenly distributing the weight, making the laundry bag 10 less likely to unbalance a washing machine.

Figure 2:
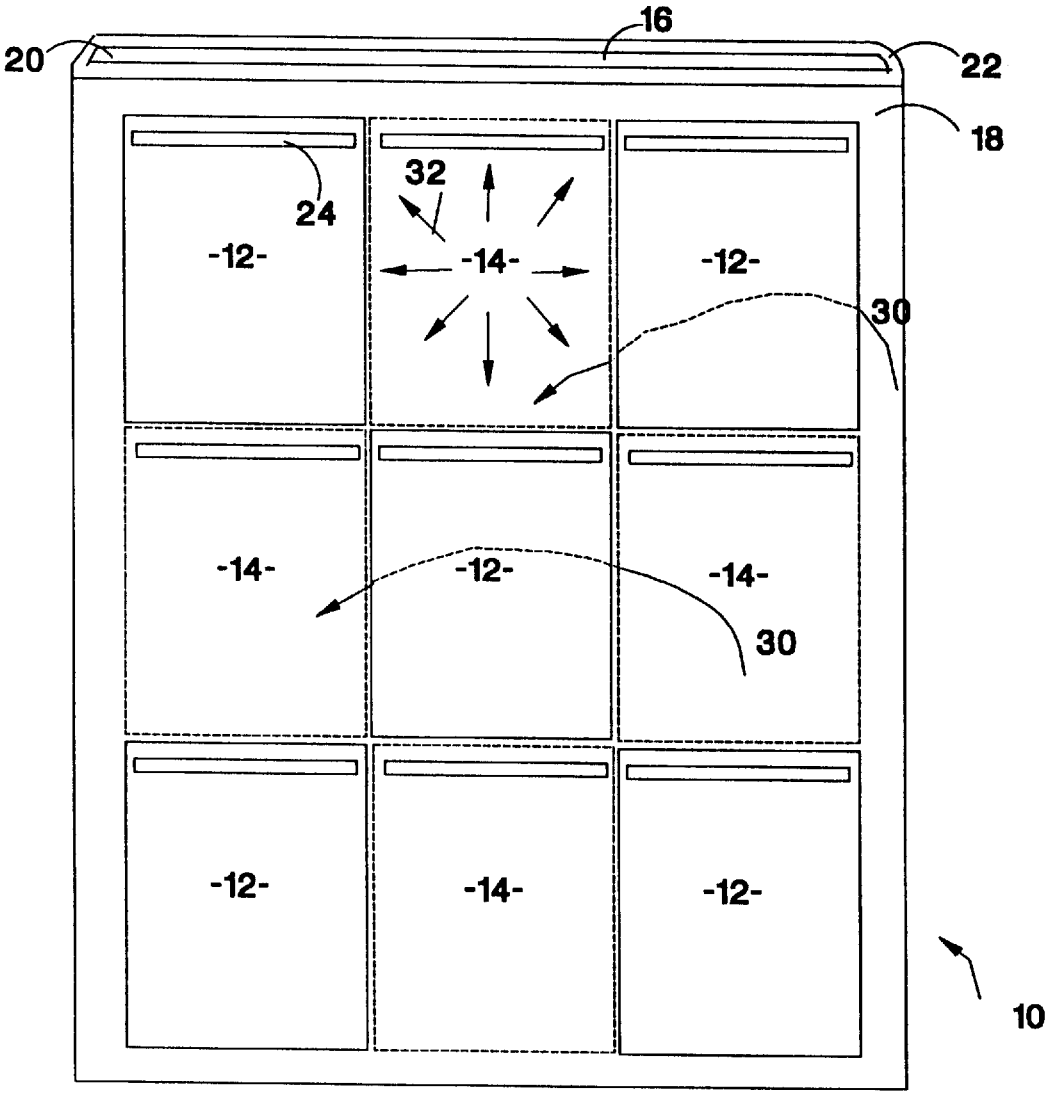
FIG. 2 illustrates the water flow through the laundry bag of FIG. 1.
Figure 3:
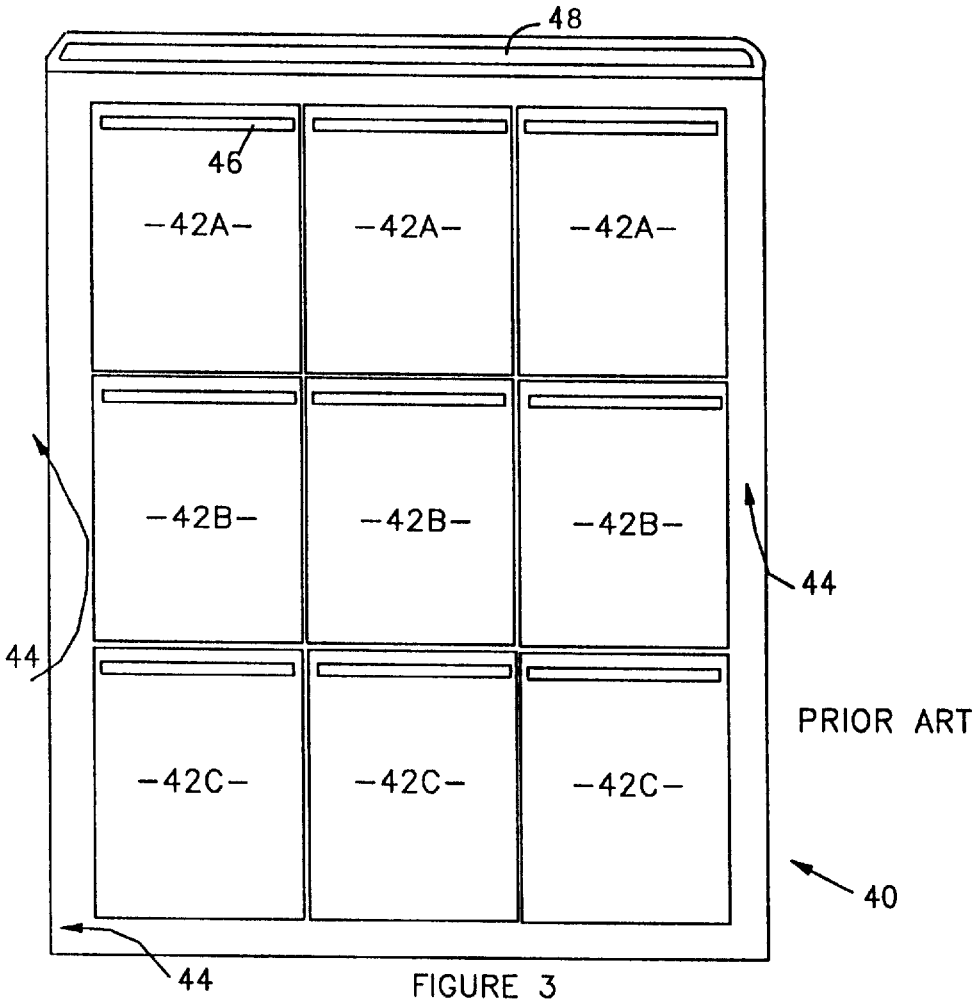
FIG. 3 illustrates the water flow through a prior art laundry bag.
Figure 4:
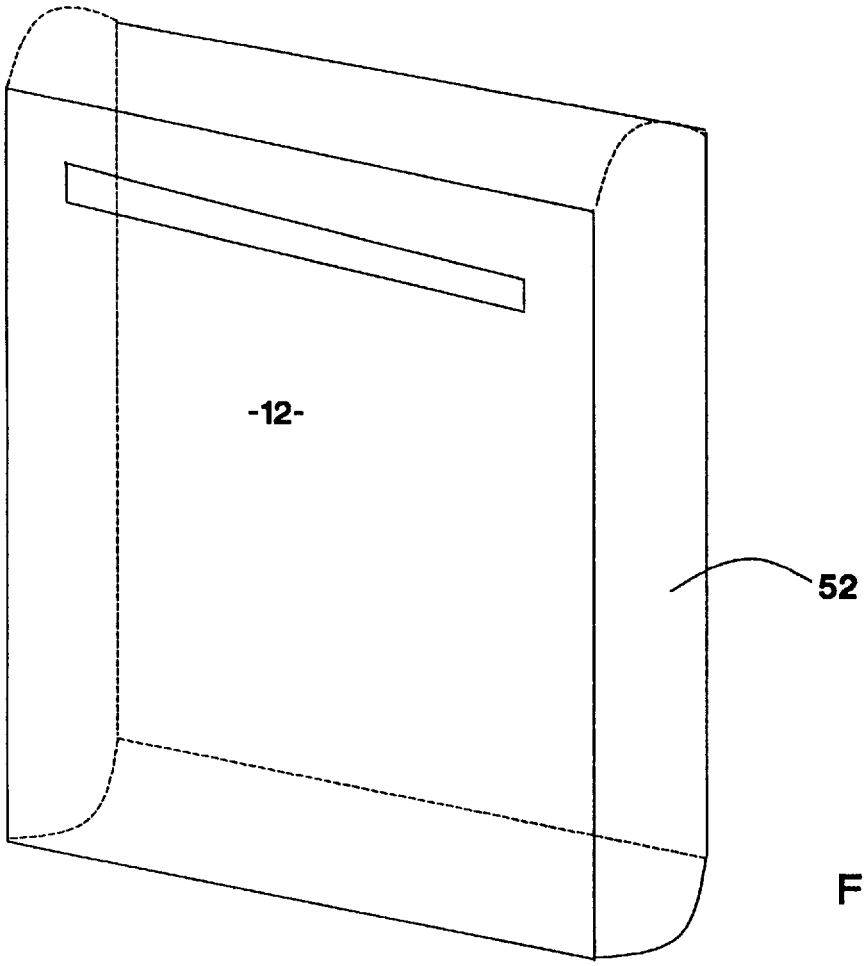
FIG. 4 is a perspective view of a filled pocket of the instant invention.

The nonaligned individual exterior pockets 12 and 14 provide a water and air flow advantage over the placement of the pockets only on one side of the bag. This is illustrated in FIGS. 2 and 3 wherein the water and air flow are indicated by arrows 30 and 44 respectively. Once the individual pockets of both the instant invention and the prior art, are filled they have depth 52, as indicated in FIG. 4. In the instant invention, the depth 52 of the nonaligned individual exterior pockets 12 and 14 is readily accessible to water and air flow. In the prior art, however, the depth created by the filled pockets is blocked from water and air flow by the adjacent pockets. In FIG. 2, the arrows 30 and 32 indicate the water or air flow as occurring from the first side 18. The water and/or air flow from the second side 20 is identical and therefore only one side is discussed. The water enters the laundry bag 10 through the open mesh areas adjacent the individual exterior pockets 12 and opposite the individual exterior pockets 14. Because the articles within the individual exterior pockets 12 and 14 and the interior pocket 16 are separated by the mesh, water is allowed to flow between the articles within the laundry bag 10. The water flows behind the individual exterior pocket 12, between the articles in the individual exterior pocket 12 and the interior or center pocket 16, as indicated by arrows 30. Water also flows directly across, through the depth 52 of the individual exterior pockets 12, as indicated by arrows 32. With the configuration of the instant invention, water and air accesses both sides, as well as the depth 52, of the articles in the individual exterior pockets 12 and 14, as well as the interior pocket 16.

In the prior art design, when individual pockets 42 are utilized, all individual pockets 42 are placed on one side of the bag 40. Each of the individual pockets 42 contain closure means 46. As illustrated by arrows 44, the water flow must be through the spacing between the individual pockets 42 or through the "back" of the bag 40. Therefore, there is minimal water flow between the contents in the individual pockets 42 and the large pocket 48. Additionally, the placement of the pockets adjacent one another blocks the flow through the depth created by placing articles in the individual pockets 42. As can be seen, the prior art placement of pockets blocks the water flow through the depth of the pockets. By abutting the pockets, the only open depth is along the perimeter of the sack.

The offset individual pockets 12 and 14 provide the additional advantage of easier accessibility. When the pockets 42 are placed one adjacent the other, accessibility to the lower rows of pockets is blocked by filled upper pockets. Therefore, if articles are placed in the pockets 42A, access to the pockets 42B are blocked. To facilitate loading and unloading, the prior art bags should be loaded 42C, 42B, then 42A. Unloading would be in the reverse order of 42A, 42B and 42C. Although accessibility is not completely blocked and access to lower pockets can be obtained even when the upper pockets are filled, convenience is hindered. Laundry is a constant, never ending chore and any means to speed up the process is advantageous. Little things, such as difficulty accessing the lower pockets of the prior art bag, may seem trivial at time of manufacture, however to someone continually doing laundry, trivial matters can become major ones. In the laundry bag 10, all pockets are provided with easy accessibility.

In both the laundry bag 10 and the prior art bag 40, there are only two layers of articles, the individual pockets and the main inner pocket. The difference in washing and drying time is in the flow of the water and air. The instant invention allows for the water or air to flow in and around the contents of the laundry bag, providing the effect of having only one layer of articles. Conversely, the prior art, due to article positioning and the constricted water and air flow, provides easy water and air access to only one side of each layer.

The individual pockets 12 and 14 are provided with closure means 24 to prevent the articles from falling out during washing. The closure means 24 can be nylon zippers, hook and wool, snaps or other such means. It is preferable that the closure be plastic, nylon or other non-heat transmitting material to allow for use in the dryer.

The mesh used in the instant invention preferably provides for maximum water and air flow, as well as separation between the individual pockets 12 and 14 and the interior pocket 16. The use of a mesh having a small opening will block the water and air flow. The mesh size must be, however, small enough to prevent the articles from coming through the mesh openings.

Figure 5:
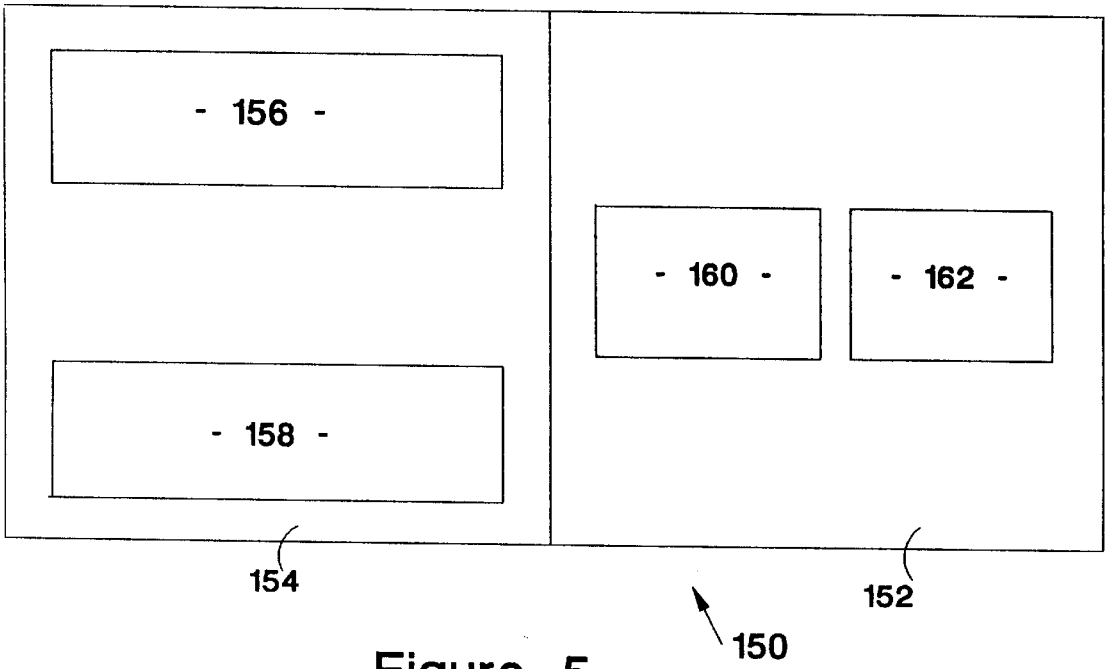
FIG. 5 is an alternate embodiment of the instant invention.

FIG. 5, the laundry bag 150 is illustrated with four pockets, two square pockets 160 and 162 placed on the first side 152 and two rectangular pockets 156 and 158 placed on the second side 154. The rectangular pockets 156 and 158 can be used for larger items, such as sneakers, socks, hat, etc. The square pockets 160 and 162 are off set from the rectangular pockets 156 and 158 to allow for the water and air flow. For example, the rectangular pockets 156 and 158 can be 8 inches by 18 inches while the square pockets 160 and 162 can be 6 ½ inches by 8 inches. Alternative sizing will become apparent to those skilled in the art. The first side 152 is attached to the second side 154 on three sides, as disclosed heretofore, leaving one side open to allow for items to be placed in the center bag.

Figure 6:
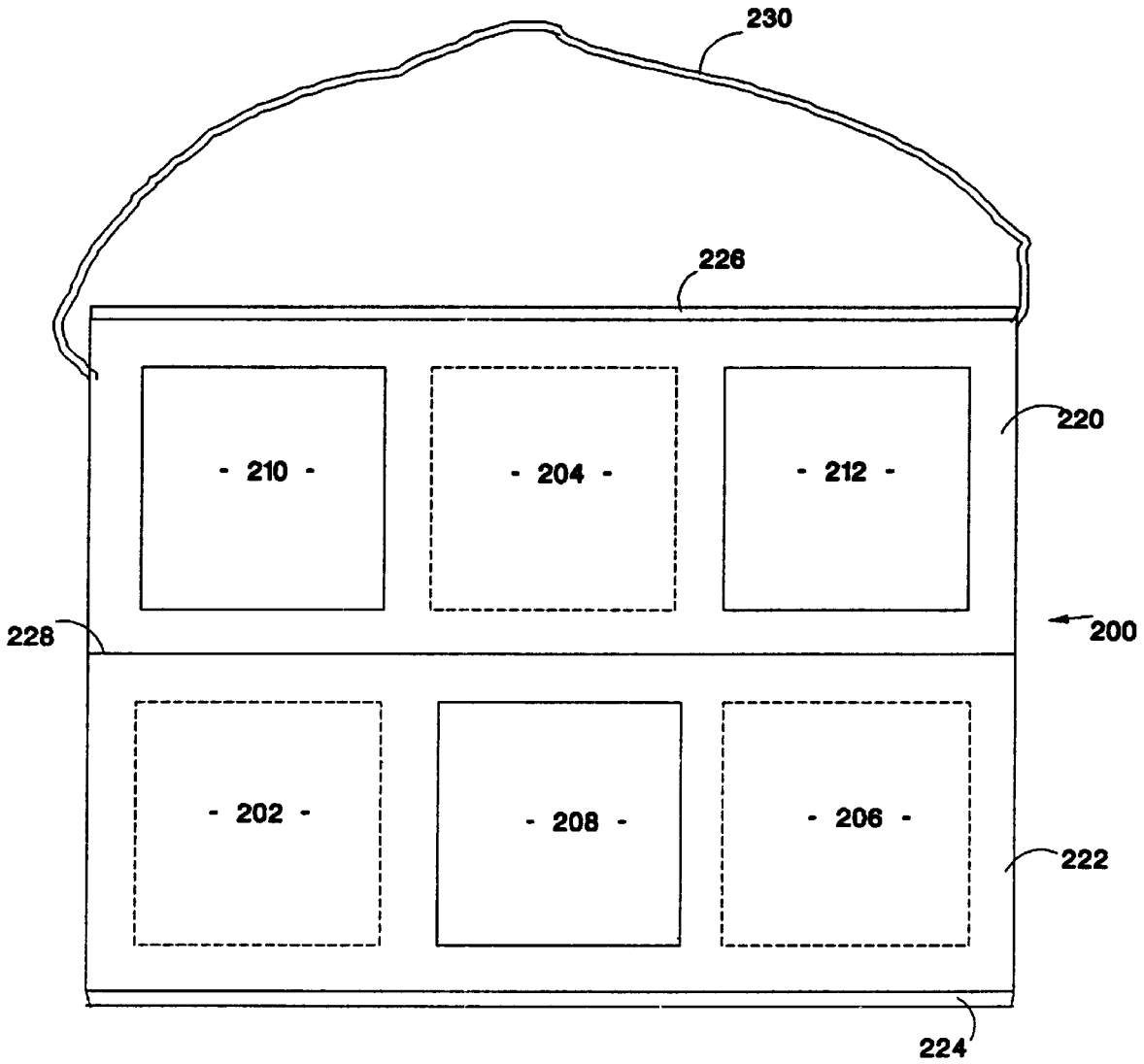
FIG. 6 is an additional embodiment of the instant invention utilizing two center bags and means for hanging the bag.

The center pocket of the laundry bag 200 of FIG. 6 is divided along separator means 228 into upper center bag 220 and lower center bag 222. Three exterior bags 210, 204 and 212 are affixed to the upper center bag 220 in the alternating fashion as disclosed heretofore. The lower center bag 222 is provided with exterior bags 202, 208 and 206, again in the alternating positioning. The upper center bag 220 and lower center bag 222 are provided with closure means 226 and 224 respectively. The closure means 226 and 224 can be zipper, two part hook and loop material, or other means convenient for securing the upper and lower center bags. The laundry bag 200 is provided with hanging means, such as loop 230, which allows the bag 200 to be hung up for drying, storage, etc. The hanging loop 230 can also be provided with a hook, as disclosed further herein.

Figure 7:
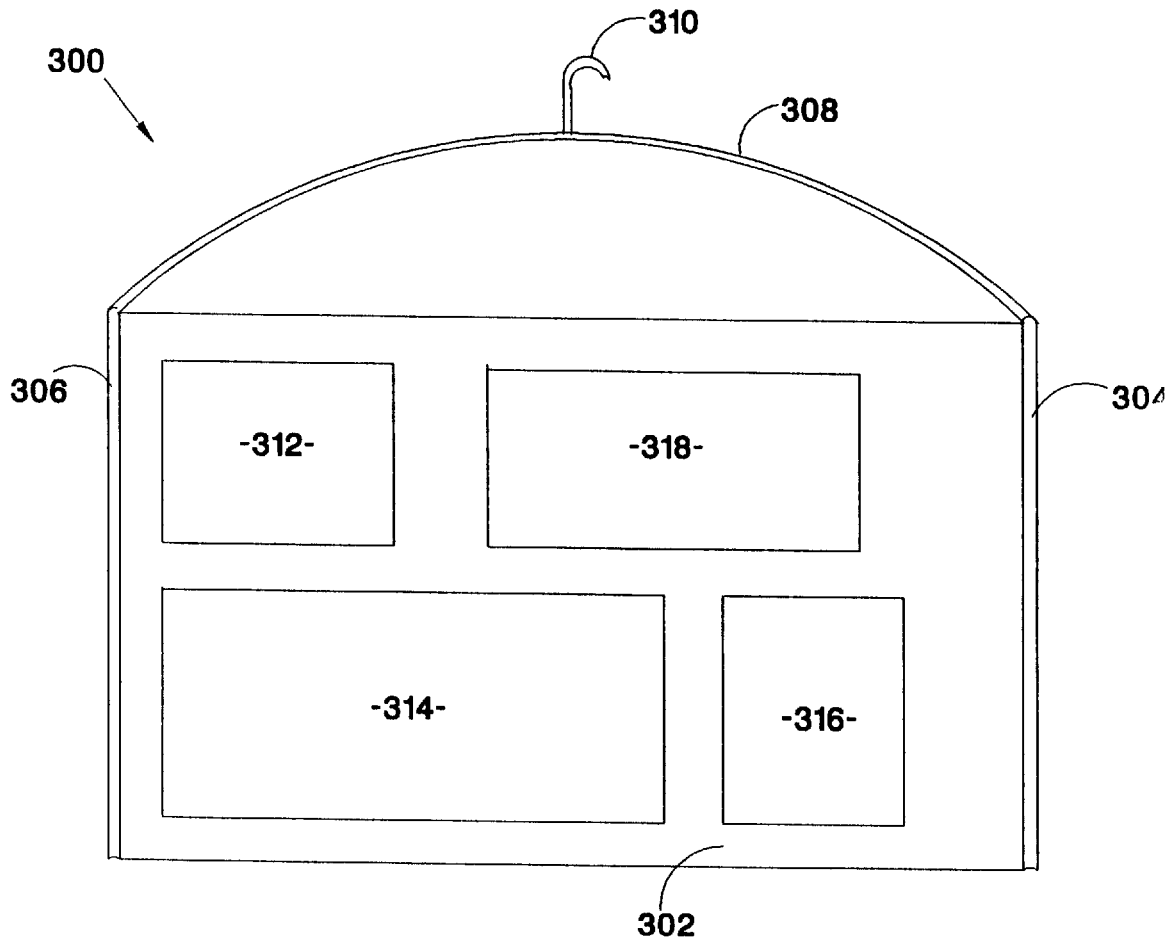
FIG. 7 is another embodiment with side closures for use as a travel or gift bag.

In FIG. 7 an alternate use for the compartmental bag 300 is illustrated. The compartmental bag 300 is used to sell or store various small articles. The outer pockets 312, 314, 316 and 318 have corresponding pockets (not shown) directly opposite the illustrated pockets. The compartmental bag 300 is ideal for traveling to carry undergarments within the outer pockets 312, 314, 316 and 318, placing dirty clothing in the center bag 302. The bag 300 is provided with a hanging loop 308 and hook 310 which allows for the compartmental bag 300 to be hung over a shower rod or closet rod. The compartmental bag 300 is provided with side closures 304 and 306 which allow for easy access to the bag 300 while hanging. Access from either the top or bottom would be awkward when the item is hanging and the side closures 304 and 306 allow for items to be either placed in, or removed, from the center bag 302 without having to remove the bag 300 from the hanging position. In this embodiment, the outer pockets 312, 314, 316 and 318 are opposite their counterparts as the pocket placement is not as critical for the storage uses as for washing and drying. The compartmental bag 300 does not necessarily need to be manufactured from mesh and can be from other materials, such as satin, which are aesthetically pleasing. By varying the material of manufacture, the compartmental bag 300 can also be used to store cosmetics, cookie cutters or other such items.

The disclosed bags are ideal for selling lingerie, or other such items, as gift items. The bags are also advantageous for traveling in that clean clothes can be carried in the outer pockets and dirty clothes stored in the center pocket. The pockets on the foregoing bags can be either offset or directly across from one another. It should also be noted that any of the foregoing embodiments can incorporate the features of any of the other disclosed bags and that the illustrations herein should not limit the designs.

As is evident from the foregoing figures, the pockets can be varied as to placement and sizing. The critical feature with the laundry bag is the fact that the pockets do not overlap one another, thereby allowing for water and air flow. The sizing and placement on the bag is not as critical and can be varied to accommodate for the end use. This variation allows for the bag sizes to be varied dependent upon final use or cost. When used as a storage bag, the offset pockets are not critical and the pocket size and placement can vary based on manufacturing criteria.

The dimensions of the laundry bag 10 illustrated in FIG. 1 is approximately 22 inches wide and 28 long. The individual exterior pockets 12 and 14 are approximately 8 inches square. This configuration is only one example, illustrating a basic design and dimensions.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A multi-pocketed bag for retaining articles comprising:

a center pocket, said center pocket having:

a first side, a second side, and an exterior perimeter, said first side and said second side being secured along at least two sides of said exterior perimeter, the unsecured sides having open and closure means;

at least two exterior pockets, said exterior pockets having a first side, a periphery, said periphery being less than said exterior perimeter, and open and closure means, said at least two exterior pockets are secured to said first side and said second side and positioned to prevent said exterior pockets secured to said first side from being directly opposite and overlapping said exterior pockets secured to said second side thereby maintaining said exterior pockets on said first side off-set to exterior pockets on said second side.

2. The multi-pocketed bag of claim 1 wherein said bag is manufactured from an open mesh fabric.

3. The multi-pocketed bag of claim 2 wherein the positioning of said exterior pockets allows for water and air flow through said center pocket.

4. The multi-pocketed bag of claim 1 wherein said first side and said second side of said center pocket are permanently affixed along two opposing sides and the unaffixed sides have open and closure means.

5. The multi-pocketed bag of claim 4 further comprising separator means, said separator means dividing said center pocket into at least two pockets, each accessible through open and closure means.

6. The multi-pocketed bag of claim 1 wherein said first side and said second side of said center pocket are permanently affixed along three sides of the exterior perimeter and the unaffixed side has open and closure means.

7. The multi-pocketed bag of claim 1 wherein said individual exterior pockets are provided with open and closure means.

8. The multi-pocketed bag of claim 1 further comprising hanging means.

9. The method of separating articles for thorough washing using a multi-pocketed bag for retaining articles comprising:

a center pocket, said center pocket having a first side, a second side, an exterior perimeter, said first side and said second side being secured along at least two sides of said exterior perimeter and closure means along the unsecured sides of said exterior perimeter; at least two exterior pockets, said exterior pockets having a first side, a periphery, said periphery being less than said exterior perimeter, and closure means, said at least two exterior pockets being secured to said first side and said second side and positioned to prevent said exterior pockets secured to said first side from being directly opposite and overlapping said exterior pockets secured to said second side, comprising the steps of:

placing articles in said exterior pockets;

affixing said closure means to prevent said article from falling out of said exterior pockets;

placing articles in said center pocket;

affixing said closure means to prevent said articles from falling out of said center pocket;

washing said articles in said bag;

drying said articles in said bag;

wherein the offset of said exterior pockets allow for water and air to move freely through said exterior pockets and said center pocket to provide thorough washing and drying of said articles.

* * * * *